US010297955B2

(12) United States Patent
Zhu et al.

(10) Patent No.: US 10,297,955 B2
(45) Date of Patent: May 21, 2019

(54) METALLIC SHELL WITH SPRING TANGS ON FOLDED PLATE

(71) Applicant: FOXCONN INTERCONNECT TECHNOLOGY LIMITED, Grand Cayman (KY)

(72) Inventors: Jian-Kuang Zhu, Kunshan (CN); Wei Zhong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/841,265

(22) Filed: Dec. 13, 2017

(65) Prior Publication Data

US 2018/0166831 A1 Jun. 14, 2018

(30) Foreign Application Priority Data

Dec. 13, 2016 (CN) ..... 2016 1 1143969

(51) Int. Cl.

| | |
|---|---|
| ***H01R 11/30*** | (2006.01) |
| ***H01R 13/6581*** | (2011.01) |
| ***H01R 13/62*** | (2006.01) |
| ***H01R 12/71*** | (2011.01) |
| *H01R 13/6582* | (2011.01) |
| *H01R 12/72* | (2011.01) |

(52) U.S. Cl.

CPC ..... *H01R 13/6581* (2013.01); *H01R 12/716* (2013.01); *H01R 13/6205* (2013.01); *H01R 12/724* (2013.01); *H01R 13/6582* (2013.01)

(58) Field of Classification Search

CPC ..... H01R 13/6581; H01R 12/716; H01R 13/6205; H01R 13/6582

USPC ..... 439/607.55, 607.56, 39

See application file for complete search history.

(56) References Cited

U.S. PATENT DOCUMENTS

| | | | | |
|---|---|---|---|---|
| 7,878,855 | B2 * | 2/2011 | Li | H01R 13/6582 439/607.45 |
| 8,353,722 | B1 * | 1/2013 | Lan | H01R 25/006 439/607.35 |
| 9,160,098 | B1 * | 10/2015 | Liao | H01R 13/5202 |
| 9,780,468 | B2 * | 10/2017 | Yokoyama | H01R 12/7047 |
| 9,985,358 | B2 * | 5/2018 | Zhu | H01R 4/023 |
| 2013/0329324 | A1 * | 12/2013 | Tziviskos | H05K 5/0247 361/56 |
| 2014/0287601 | A1 * | 9/2014 | Suh | H01R 13/6205 439/39 |
| 2014/0322929 | A1 * | 10/2014 | Asai | H01R 13/6205 439/39 |

(Continued)

FOREIGN PATENT DOCUMENTS

CN 203589349 U 5/2014

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical connector includes an insulative housing and a metallic shielding shell enclosing the housing. The housing forms a mating cavity. The metallic shell includes a first shell having a main part attached upon the exterior surface of the housing, and a folded forwardly extending from a rear edge of the main part with a plurality of spring tangs for engagement with the enclosure of an electronic device.

20 Claims, 5 Drawing Sheets

(56) References Cited

U.S. PATENT DOCUMENTS

| | | | | |
|---|---|---|---|---|
| 2015/0104959 | A1* | 4/2015 | Guo | H01R 13/506 439/39 |
| 2015/0214654 | A1* | 7/2015 | Huang | H01R 12/61 439/39 |
| 2015/0325949 | A1* | 11/2015 | Wei | H01F 7/0263 439/39 |
| 2017/0093062 | A1* | 3/2017 | Yokoyama | H01R 12/7047 |
| 2017/0256881 | A1* | 9/2017 | Lambie | H01R 13/5219 |
| 2017/0279226 | A1* | 9/2017 | Tsai | H01R 13/6581 |
| 2018/0166831 | A1* | 6/2018 | Zhu | H01R 13/6581 |

* cited by examiner

METALLIC SHELL WITH SPRING TANGS ON FOLDED PLATE

1. FIELD OF THE DISCLOSURE

The invention is related to an electrical connector, and particularly to the electrical connector with a specific shielding shell thereof.

2. DESCRIPTION OF RELATED ARTS

U.S. Pat. No. 9,252,531 discloses the connector with a pair of magnets enclosed in the metallic shell while lacking the reliable retention thereto.

It is desired to provide an electrical connector with the shielding shell providing a container structure snugly retaining the corresponding magnets therein.

SUMMARY OF THE DISCLOSURE

To achieve the above desire, an electrical connector includes an insulative housing and a metallic shielding shell enclosing the housing. The housing forms a mating cavity. The metallic shell includes a first shell having a main part attached upon the exterior surface of the housing, and a folded forwardly extending from a rear edge of the main part with a plurality of spring tangs for engagement with the enclosure of an electronic device.

DETAILED DESCRIPTION OF THE PREFERRED EMBODIMENT

Figure 1:
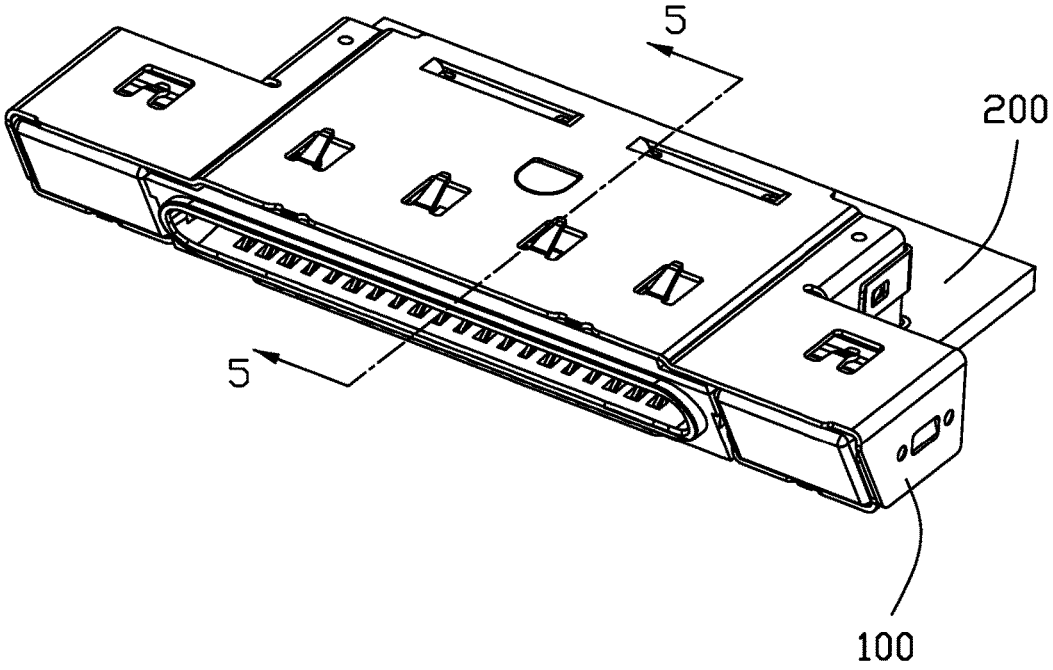
FIG. 1 is a front perspective view of an electrical connector mounted upon the printed circuit board according to the invention.
Figure 2:
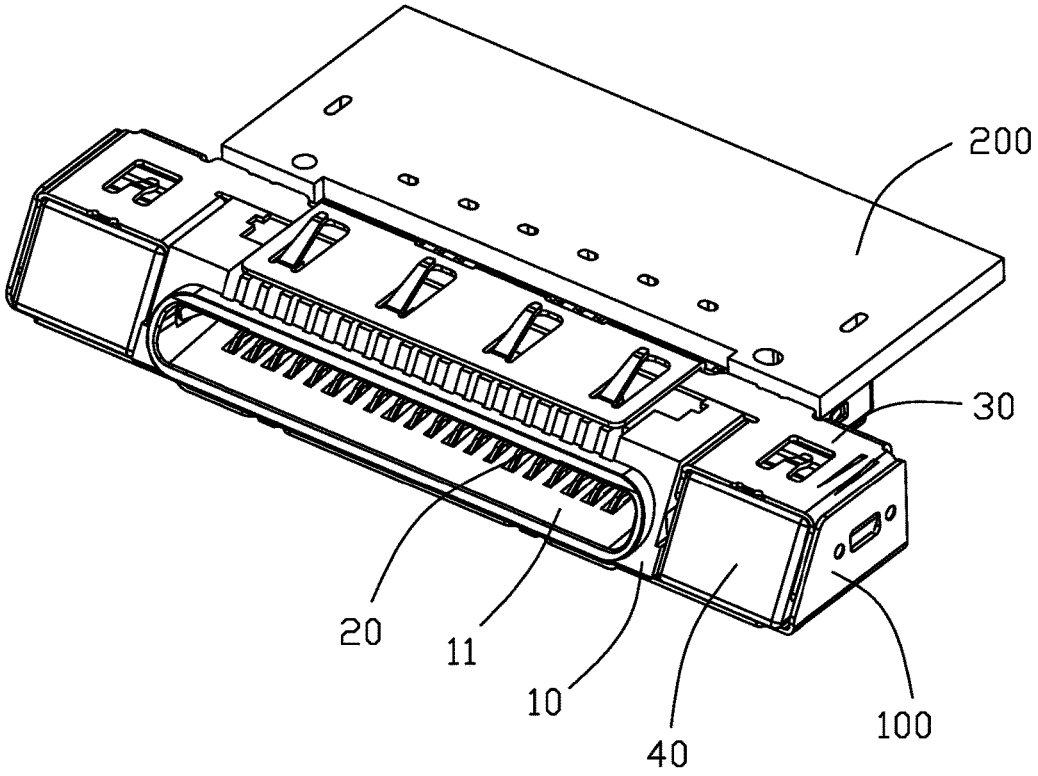
FIG. 2 is an upside-down front perspective view of the electrical connector of FIG. 1.
Figure 3:
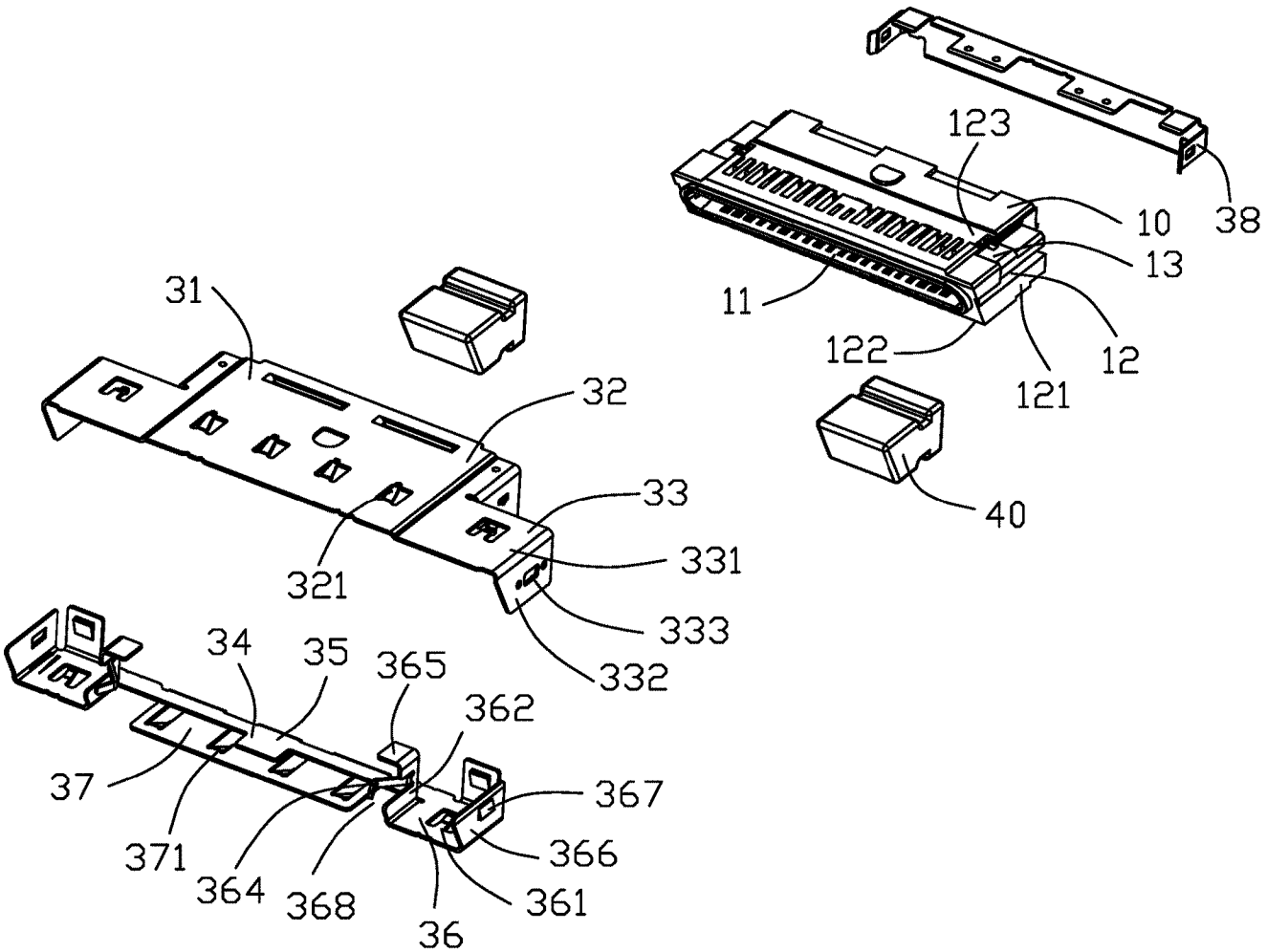
FIG. 3 is an exploded perspective view of the electrical connector of FIG. 1.
Figure 4:
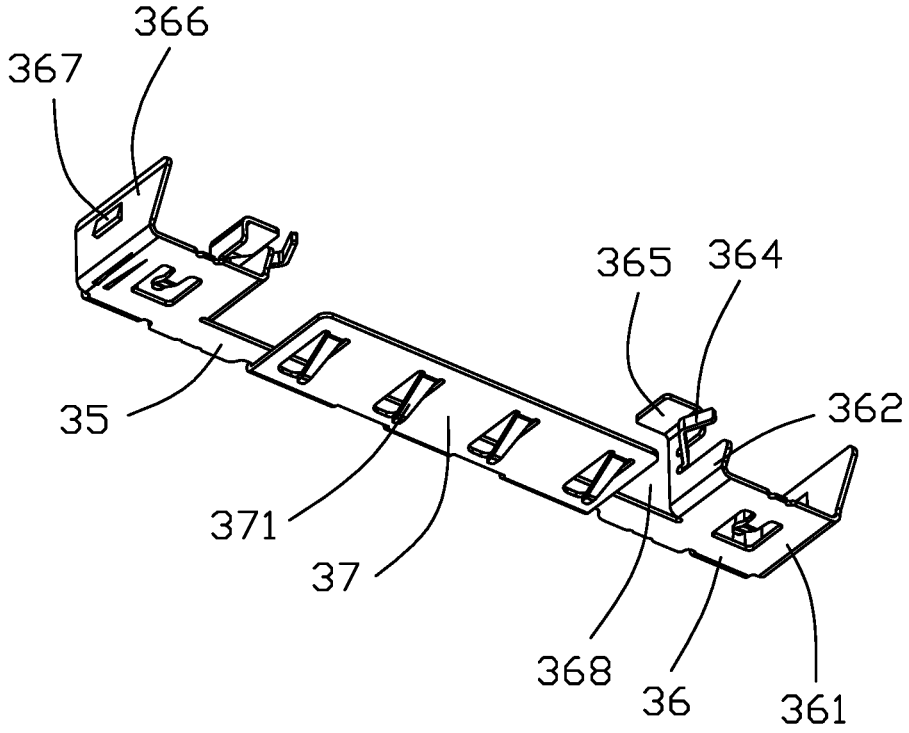
FIG. 4 is a perspective view of the first shell of the electrical connector of FIG. 1.
Figure 5:
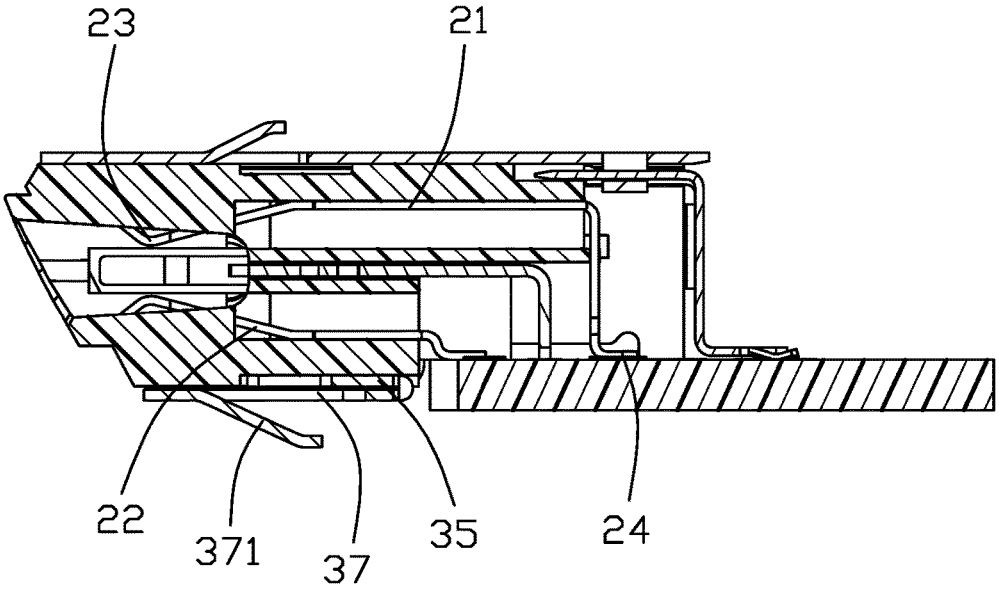
FIG. 5 is a cross-sectional view of a part of the electrical connector of FIG. 1.

Reference will now be made in detail to the embodiments of the present disclosure. Referring to FIGS. 1-5, an electrical connector 100 for mounting to a printed circuit board 200, includes an insulative housing 10, a plurality of contacts 20 disposed in the housing 10, a pair of magnets 40 at two opposite ends of the housing 10 in a transverse direction, and a metallic shielding shell 30 enclosing both the housing 10 and the magnets 40.

The housing 10 forms a mating cavity 11 forwardly communicating with an exterior for mating with a complementary connector (not shown). The housing 10 includes a pair of side grooves 12 sidewardly communicating with the mating cavity in the transverse direction. The housing 10 includes a lower/first surface 122, an upper/second surface 123, and two side surfaces 121. The contacts 20 includes a row of first contacts 21 and another row of second contacts 22, and each of the first contacts 21 and the second contacts 22 has a contacting section 23 extending into the mating cavity 11 and a soldering section 24 extending out of the housing 10 for soldering to the printed circuit board 200.

The shielding shell 30 includes a first shell 34, a second shell 31 and a third shell 38 secured together. The first shell covers the lower surface 122 of the housing 10 and the second shell 31 covers the upper surface 123. The first shell 34 includes a first main part 35 attached upon the exterior surface of the housing 10, and a folded part 37 extending forwardly from a rear edge of the main part 35, intimately attached upon the main part 35, and further extending forwardly beyond the main part 35 and attached upon an exterior surface of the housing 10. A plurality of first spring tangs 371 extend rearward from the folded part 37 for engagement with the case of the electronic device (not shown).

The first shell 34 further includes a pair of first wings 36 including a first horizontal section 361, a first/inner extension 362 and a second/outer extension 366 both extending from opposite inner and outer side edges of the first horizontal section 361. The first extension 362 further includes a spring finger 364 extending through the corresponding groove 12 into the mating cavity 11 for engagement with a metallic shell of the complementary connector (not shown) received within the mating cavity 11. The first extension 362 further includes a bending section 365 to abut against the step 13 of the upper surface 123. The spring finger 364 and the bending section 365 commonly take and require material of the first shell 34, when extended in a plane before bending/forming, more than the space 368 formed between the folded part 37 and the first wing 36 in a top view. Because the folded part 37 has a required minimum dimension in the transverse direction, this is the reason why the folded part 37 is required to be backwardly folded to extend forwardly from a rear edge of the main part 35 instead of directly from the front edge of the main part 35. In other words, there is no sufficient material for the first shell to 37 to commonly form the first wing 36 and the folded part 37 if the folded part 37 is not folded from the rear edge of the main part 35 to extend forwardly but directly extending forwardly from the front edge of the main part 35.

The second shell 31 includes a second main part 32 covering the upper surface 123, and a pair of second wings 33 at two opposite ends of the second main part 32 in the transverse direction. The second main part 32 forms a plurality of second spring tangs 321 extending opposite to the first spring tangs 371 in the front-to-back direction for engagement with the case of the electronic device. The second wing 33 includes a second horizontal section 331 and a third extension 332 extending from an outer edge of the second horizontal section 331. The third extension 332 abuts against the second extension 366 in the transverse direction. The first wing 36 and the corresponding second wing 33 commonly form a receiving space as a container to receive the corresponding magnet 40 therein. The second extension 366 includes a locking tab 367 to be engaged within a locking hole 333 in the third extension 332.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing forming a mating cavity to forwardly communicate with an exterior in a front-to-back direction, and including opposite first and second surfaces in a vertical direction perpendicular to the front-to-back direction;

a plurality of contacts disposed in the housing with corresponding mating sections extending into the mating cavity;

a metallic shielding shell including a first shell and a second shell assemble together to respective cover the first surface and the second surface, the first shell including a first main part covering the first surface, and a folded part extending forwardly from a rear edge of the first main part, and a pair of first wings located at two opposite ends thereof in a transverse direction perpendicular to both the front-to-back direction and the vertical direction; and a pair of magnets received within the first wings, respectively;

wherein a part of the folded part is intimately positioned on the first main part in a folded manner.

2. The electrical connector as claimed in claim 1, wherein the folded part forms a plurality of first spring tangs extending outwardly for engagement with a case of an external electronic device.

3. The electrical connector as claimed in claim 1, wherein the first wing includes a first horizontal section and a first extension extending from an inner edge of the first horizontal section, and a bending section extending from the first extension, and wherein before bending and forming, the horizontal section, the first extension and the bending section commonly extend in a plane extends beyond the folded part in the transverse direction.

4. The electrical connector as claimed in claim 3, wherein said first extension and said bending section abut against the housing.

5. The electrical connector as claimed in claim 3, wherein the first wing further includes a the spring finger extending from the first extension through a groove in the housing into the mating cavity in the transverse direction.

6. The electrical connector as claimed in claim 1, wherein the housing forms a pair of grooves in two opposite ends in said transverse direction, and each of the first wings includes a spring finger extending through the corresponding groove into the mating cavity in the transverse direction for engagement with a complementary connector received within the mating cavity.

7. The electrical connector as claimed in claim 1, wherein the second shell includes a second main part covering the second surface, and a pair of second wings at two opposite ends there of in the transverse direction, and the first wings and the second wings are secured to each other in the vertical direction.

8. The electrical connector as claimed in claim 7, wherein the first wing further includes a second extension extending from an outer edge of the corresponding first horizontal section, and the second wing further includes a third extension extending from an outer edge of the corresponding second horizontal section, and one of the second extension and the third extension forms a locking tab and the other forms a locking hole for securing the first wing and the second wing together in the first direction.

9. An electrical connector comprising:

an insulative housing forming a mating cavity to forwardly communicate with an exterior in a front-to-back direction, and including opposite first and second surfaces in a vertical direction perpendicular to the front-to-back direction;

a plurality of contacts disposed in the housing with corresponding mating sections extending into the mating cavity;

a metallic shielding shell including at least a first shell to cover the first shell, the first shell including a first main part covering the first surface, and a folded part extending from one edge of the first main part in a folded manner along the front-to-back direction, and a pair of first wings located at two opposite ends thereof in a transverse direction perpendicular to both the front-to-back direction and the vertical direction; and a pair of magnets received within the first wings, respectively, each of the first wings includes a spring finger extending through a groove of the housing into the mating cavity in the transverse direction;

wherein a part of the folded part is attached on the first main part intimately.

10. The electrical connector as claimed in claim 9, wherein said folded part extends forwardly from a rear edge of the first main part in the front-to-back direction.

11. The electrical connector as claimed in claim 10, wherein said folded part further forms a plurality of outwardly extending first spring tangs for engagement with a case of an external electronic device.

12. The electrical connector as claimed in claim 11, wherein said first spring tangs extend rearwardly in the front-to-back direction.

13. The electrical connector as claimed in claim 9, wherein the first wing includes a first horizontal section and a first extension extending from an inner edge of the first horizontal section, and a bending section extending from the first extension, and wherein before bending and forming, the horizontal section, the first extension and the bending section commonly extend in a plane extends beyond the folded part in the transverse direction.

14. The electrical connector as claimed in claim 13, wherein said first extension and said bending section abut against the housing.

15. The electrical connector as claimed in claim 13, wherein the first wing further includes a spring finger extending from the first extension through a groove in the housing into the mating cavity in the transverse direction.

16. The electrical connector as claimed in claim 9, wherein the housing forms a pair of grooves in two opposite ends in said transverse direction, and each of the first wings includes a spring finger extending through the corresponding groove into the mating cavity in the transverse direction for engagement with a complementary connector received within the mating cavity.

17. The electrical connector as claimed in claim 9, wherein the folded part abuts against not only the first main part but also the first surface of the housing in the vertical direction.

18. An electrical connector comprising:

an insulative housing forming a mating cavity to forwardly communicate with an exterior in a front-to-back direction, and including opposite first and second surfaces in a vertical direction perpendicular to the front-to-back direction;

a plurality of contacts disposed in the housing with corresponding mating sections extending into the mating cavity; and a metallic shielding shell including a first shell and a second shell assemble together to respective cover the first surface and the second surface, the first shell including a first main part covering the first surface, and a folded part extending from one edge of the first main part in a folded manner along the front-to-back direction, and a pair of first wings located at two opposite ends thereof in a transverse direction perpendicular to both the front-to-back direction and the vertical direction; wherein the folded part forms a plurality of outwardly extending first spring tangs for engagement with a case of an external electronic device;

wherein a part of the folded part is intimately positioned on the first main part.

19. The electrical connector as claimed in claim 18, wherein said pair of wings receive a pair of magnets respectively.

20. The electrical connector as claimed in claim 18, wherein each of the first wings includes a spring finger extending through a groove of the housing into the mating cavity in the transverse direction.

* * * * *